US010221691B2

(12) United States Patent
Mariotti et al.

(10) Patent No.: US 10,221,691 B2
(45) Date of Patent: Mar. 5, 2019

(54) METHOD OF CONNECTING AN IMPELLER TO A SHAFT, CONNECTION ARRANGEMENT AND ROTARY MACHINE

(71) Applicant: Nuovo Pignone Srl, Via Felice Matteucci (IT)

(72) Inventors: Gabriele Mariotti, Florence (IT); Enrica Caterina Benedetto, Florence (IT); Alberto Scotti Del Greco, Florence (IT); Marco Mencagli, Florence (IT)

(73) Assignee: Nuovo Pignone Srl, Florence (IT)

( * ) Notice: Subject to any disclaimer, the term of this patent is extended or adjusted under 35 U.S.C. 154(b) by 358 days.

(21) Appl. No.: 14/896,465

(22) PCT Filed: Jun. 5, 2014

(86) PCT No.: PCT/EP2014/061747
§ 371 (c)(1),
(2) Date: Dec. 7, 2015

(87) PCT Pub. No.: WO2014/198640
PCT Pub. Date: Dec. 18, 2014

(65) Prior Publication Data

US 2016/0130947 A1 May 12, 2016

(30) Foreign Application Priority Data

Jun. 10, 2013 (IT) ..... CO2013A0022

(51) Int. Cl.
*F01D 5/02* (2006.01)
*F04D 29/26* (2006.01)
*F01D 25/16* (2006.01)

(52) U.S. Cl.
CPC ..... *F01D 5/025* (2013.01); *F01D 5/026* (2013.01); *F01D 25/16* (2013.01); *F04D 29/266* (2013.01);
(Continued)

(58) Field of Classification Search
None
See application file for complete search history.

(56) References Cited

U.S. PATENT DOCUMENTS 4,836,706 A * 6/1989 Mitchell ..... B23B 29/046 403/24
5,169,297 A * 12/1992 Mizuno ..... F01D 5/025 416/244 A
(Continued)

FOREIGN PATENT DOCUMENTS

CN 1450943 A 10/2003
DE 102008058506 A1 * 5/2010 ..... F01D 5/066
(Continued)

OTHER PUBLICATIONS

Unofficial English Translation of Chinese Office Action issued in connection with corresponding CN Application No. 201480031193.5 dated Dec. 5, 2016.
(Continued)

*Primary Examiner* — Jason D Shanske
*Assistant Examiner* — Theodore C Ribadeneyra
(74) *Attorney, Agent, or Firm* — GE Global Patent Operation

(57) ABSTRACT

A connection arrangement comprising a shaft having an axial through hole, a tie rod located inside the axial through hole, an impeller comprising a solid hub, a plurality of blades, and an integral stub protruding axially from the solid hub; at an end of the tie rod there is an integral body having a shape radially protruding from the tie rod; the stub has a
(Continued)

cavity for receiving the body and an axial hole for inserting the body into the cavity; the stub axial hole has a shape corresponding to the shape of the body; the cavity is so sized and shaped as to allow rotation of the body inside the cavity and trapping of the body in the cavity once rotated; the shaft and the impeller are coupled together by a coupling.

14 Claims, 5 Drawing Sheets

(52) U.S. Cl.
CPC ..... *F05D 2220/30* (2013.01); *F05D 2220/40* (2013.01); *F05D 2230/60* (2013.01); *F05D 2240/24* (2013.01); *F05D 2240/52* (2013.01); *F05D 2240/60* (2013.01)

(56) References Cited

U.S. PATENT DOCUMENTS 5,339,521 A 8/1994 Kawase
6,499,969 B1 * 12/2002 Tombers ..... F01D 5/025 416/204 A
6,540,449 B1 4/2003 Bejerstaal et al.
9,835,164 B2 * 12/2017 Svihla ..... F04D 29/266
2004/0202556 A1 * 10/2004 Svihla ..... F01D 5/026 417/407
2005/0111998 A1 5/2005 Louthan et al.
2011/0229325 A1 * 9/2011 Czerwinski ..... F01D 5/025 416/171
2012/0039722 A1 2/2012 Huetten
2012/0093661 A1 * 4/2012 Vick ..... F04D 25/04 416/244 R

FOREIGN PATENT DOCUMENTS

RU 2231690 C1 6/2004
UA 82237 C2 3/2008

OTHER PUBLICATIONS

International Search Report and Written Opinion dated Oct. 16, 2014 which was issued in connection with PCT Patent Application No. PCT/EP2014/061747 which was filed on Jun. 5, 2014.
Italian Search Report and Written Opinion dated Feb. 27, 2014 which was issued in connection with Italinan Patent Application No. CO2013A000022 which was filed on Jun. 10, 2013.
Decision to grant and search report issued in connection with corresponding RU Application No. 2015149784 dated Apr. 25, 2018.

* cited by examiner

METHOD OF CONNECTING AN IMPELLER TO A SHAFT, CONNECTION ARRANGEMENT AND ROTARY MACHINE

BACKGROUND

Embodiments of the present invention relates to a method of connecting an impeller to a shaft through a tie rod, a connection arrangement and a rotary machine.

In many technical fields, an impeller and a shaft are connected together so that they rotate integrally. In some applications, there is a need to transmit a torque (and power) from the impeller to the shaft; in some applications, there is a need to transmit a torque (and power) from the shaft to the impeller; in some applications, more in general, the torque (and power) is transmitted from the impeller or to the impeller depending on the operating condition of the machine.

A well known solution for connecting an impeller to a shaft in e.g. overhung configuration provides for a threaded blind hole at one end of the shaft, an axial through hole in the hub of the impeller, a fastener in the form of a bolt; the impeller is placed close to the shaft so that the hole of the impeller is aligned to the hole of the shaft, the fastener is inserted in the hole of the impeller, and it is tightened in the hole of the shaft to firmly connect the impeller to the shaft.

A disadvantage of this well known solution is that the impeller is weakened because of the axial through hole. In fact, any rotating impeller is stressed by the centrifugal forces that are proportional to the square of the rotation speed, and the axial through hole causes an increase in the intensity of this kind of stress with respect to the intensity of the stress in a solid impeller. Due to the increase in the stress, it is necessary to limit the rotation speed of the impeller and thus tip speed of its blades and thus, in case of e.g. a compressor impeller, its head.

This disadvantage applies fully to all solutions wherein the impeller has an axial through hole regardless of its size.

This disadvantage applies partially to all solution wherein the hub of the impeller has an axial blind hole regardless of its size.

Therefore, there is a general need to find improved solutions for connecting impellers to shafts.

SUMMARY OF THE INVENTION

Embodiments of the invention relate to using an impeller comprising a solid hub, a plurality of blades, and an integral stub protruding axially from the solid hub; in this way, if a hole or a recess is necessary, it may be located in the stub without weakening the hub of the impeller.

Embodiments of the invention also relate to transmitting axial load and torque through distinct parts so that it would have been easier to design each of these parts according to the corresponding requirements.

According to a first aspect, the present invention relates to a method of connecting an impeller to a shaft through a tie rod, wherein a bayonet coupling couples the tie rod to the impeller, and wherein a hirth coupling or a spline coupling couples the shaft to the impeller. In other embodiments, the bayonet coupling might be equivalently replaced by another kind of coupling able to transmit axial load. In other embodiments, the hirth coupling or spline coupling might be equivalently replaced by another kind of coupling able to transmit torque.

According to a second aspect, the present invention relates to a connection arrangement comprising a shaft having an axial through hole, a tie rod located inside the axial through hole, wherein at an end of the tie rod there is an integral body having a shape radially protruding from the tie rod, an impeller comprising a solid hub, a plurality of blades, and an integral stub protruding axially from the solid hub; wherein the stub has a cavity for receiving the body and an axial hole for inserting the body into the cavity, the stub axial hole having a shape corresponding to the shape of the body, the cavity being so sized and shaped as to allow rotation of the body inside the cavity and trapping of the body in the cavity once rotated; wherein the shaft and the impeller are coupled together by a coupling; whereby the trapping allows transmission of axial load between the tie rod and the impeller; whereby the coupling allows transmission of torque between the shaft and the impeller.

According to another aspect, the present invention relates to a rotary machine, in particular a turbo expander, comprising at least one connection arrangement as defined above.

BRIEF DESCRIPTION OF THE DRAWINGS

Embodiments of the present invention will become more apparent from the following description of embodiments thereof to be considered in conjunction with annexed drawings wherein:

FIG. 2A and FIG. 2B, FIGS. 3A, 3B, 3C, and 3D show details of FIG. 2B in four different conditions.

DETAILED DESCRIPTION

The following description of exemplary embodiments refer to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
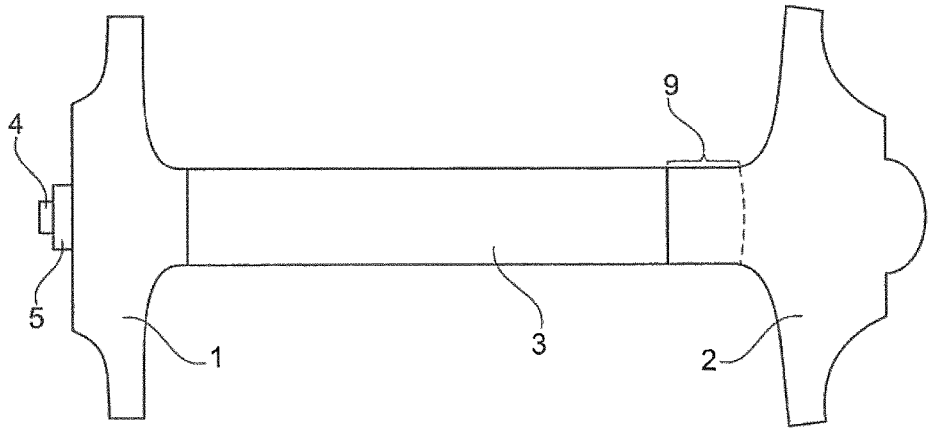
FIG. 1 shows a simplified lateral view of the essential components of a rotary machine according to an embodiment of the present invention.

FIG. 1 shows an arrangement corresponding to the essential components of an embodiment of a rotary machine according to an embodiment of the present invention; this rotary machine is a turbo expander.

Figure 2A:
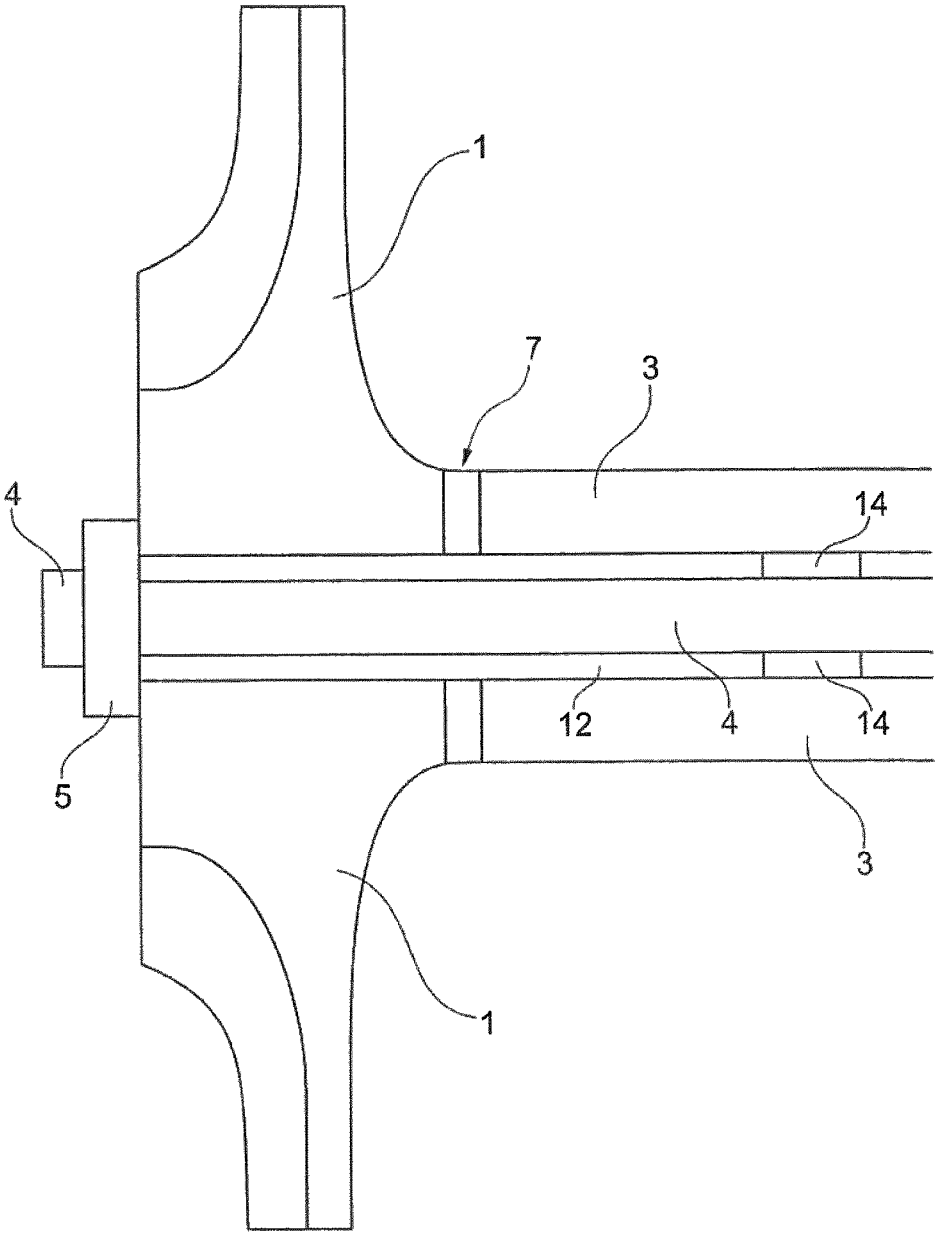
FIGS. 2A and 2B show a longitudinal cross-section of the embodiment FIG. 1 split in two partial views
Figure 2B:
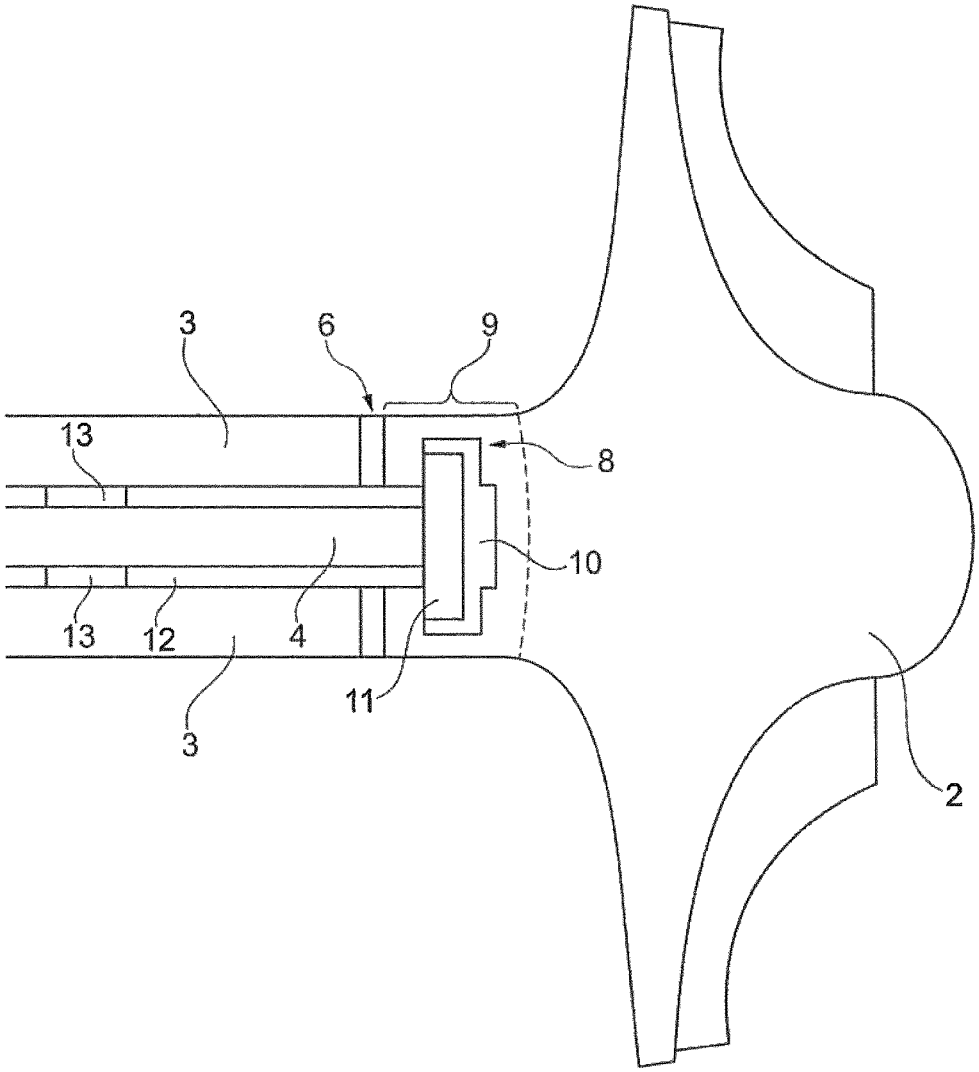

The internal details of the arrangement of FIG. 1 are shown, although schematically, in FIG. 2A and FIG. 2B; FIG. 2A relates to the turbine side and FIG. 2B relates to the compressor side.

There is a turbine impeller 1 and a compressor impeller 2; they are fixedly connected to a cylindrical shaft 3, that is in a single piece, at its ends.

There is also a tie rod 4; only a small portion of the tie rod 4 can be seen in FIG. 1 as it protrudes from the turbine impeller 1. A nut 5 is screwed onto an end of the tied rod 4, that is threaded, and is adjacent to the turbine impeller 1. The tie rod 4 and the nut 5 maintain the turbine impeller 1, the compressor impeller 2 and the shaft 3 fixed together; in other words, the tie rod 4 is secured to the shaft 3 through the impeller 1 by means of the nut 5. In order to achieve a good fixing the tie rod 4 is tensioned before screwing the nut 5.

In order to understand where the tie rod 4 is located and how it is coupled to the compressor impeller 2, reference should be made to FIG. 2A and FIG. 2B.

From FIG. 1, there appears that the compressor impeller 2 comprises a solid hub, a plurality of blades, and an integral stub 9 protruding axially from the solid hub; this stub 9 is adjacent to the shaft 3 and they have the same diameter at least at their interface. The turbine impeller 1 comprises a hub, a plurality of blades, and a very short integral stub that protrudes axially from the hub; this very short stub is adjacent to the shaft 3 and they have the same diameter at least at their interface.

In the following, reference will be made particularly to FIG. 2A and FIG. 2B.

The shaft 3 is a cylindrical element in a single piece. It is hollow; in particular, it has an axial through hole 12; more particularly, in embodiments the hole 12 is cylindrical.

When the arrangement of FIG. 1 is assembled, most of the tie rod 4 is located inside the hole 12 of the shaft 3. The cross-section of the tie rod 4 is a bit smaller than the cross-section of the hole 12. Devices 13 and 14 maintain the tie rod 4 centered inside the hole 12 and reduce vibrations; for this reason, they are called "anti-vibration dampers"; in FIG. 2A and FIG. 2B, there is a first anti-vibration damper 13 close to a first end of the shaft 3 and a second anti-vibration damper 14 close to a second end of the shaft 3; according to a different embodiment, for example, an anti-vibration damper may be located in a median zone between the first end and the second end of the shaft 3 and may be an alternative or an addition to the anti-vibration dampers at the ends of the shaft 3.

When the arrangement of FIG. 1 is assembled, a first end part of the tie rod 4 protrudes axially from the shaft 3 on a first side thereof and is located inside the turbine impeller 1 (see FIG. 2A); a second end part of the tie rod 4 protrudes axially from the shaft 3 on a second side thereof and is located inside the compressor impeller 2 (see FIG. 2B).

In FIG. 2A, the shaft 3 and the turbine impeller 1 are coupled together through a hirth coupling 7; instead of a hirth coupling (i.e. having radial teeth) another kind of coupling may be used, for example a spline coupling (i.e. having axial teeth) or a coupling having teeth inclined with respect to both the radial direction and the axial direction; it is also possible to combine two different couplings.

The coupling 7 is located at an outer perimeter region of the very short stub of the impeller 1.

The turbine impeller 1 has an axial through hole (e.g., a cylindrical hole); specifically, this axial through hole is in the hub of the impeller 1 and does not affect the blades of the impeller 1 that project from the hub; a part of the tie rod 4 is located inside this through hole. When the arrangement of FIG. 1 is assembled, the first end part of the tie rod 4 protrudes axially also from the impeller 1 (see FIG. 2A); this first end part is threaded; the nut 5 is screwed onto to it and is adjacent to the turbine impeller 1.

In FIG. 2B, the shaft 3 and the compressor impeller 2 are coupled together through a hirth coupling 6; instead of a hirth coupling (i.e. having radial teeth) another kind of coupling may be used, for example a spline coupling (i.e. having axial teeth) or a coupling having teeth inclined with respect to both the radial direction and the axial direction; it is also possible to combine two different couplings.

The coupling 6 is located at an outer perimeter region of the stub 9 of the impeller 2.

From FIG. 2B, it is clear that the compressor impeller 2 comprises a solid hub, a plurality of blades, and an integral stub (labeled 9 in FIG. 1) protruding axially from the solid hub.

The second end part of the tie rod 4 is located inside the stub 9 of the compressor impeller 2; at this second end, there is a body 11 that is integral with the tie rod 4; the body 11 has a shape radially protruding from the tie rod 4.

Figure 3A:
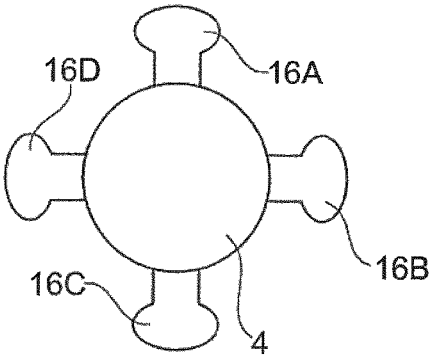
Figure 3B:
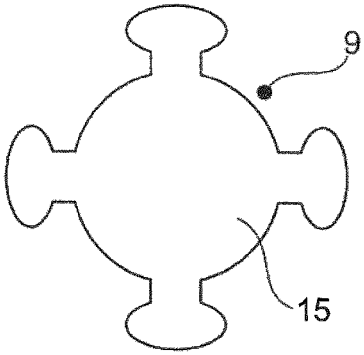
Figure 3C:
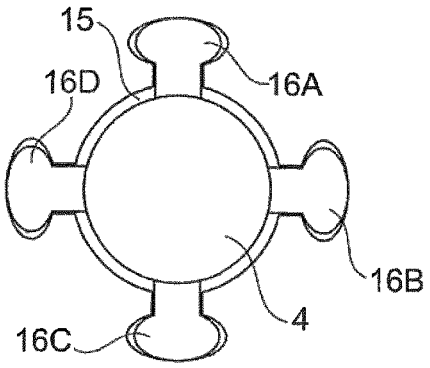
Figure 3D:
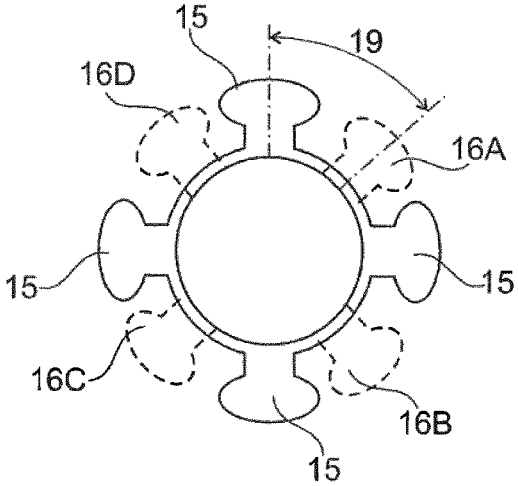

The stub 9 has a cavity 10 for receiving the body 11; there is also an axial hole, labeled 15 in FIGS. 3A-3D, for inserting the body 11 into the cavity 10; in order to allow such insertion, the hole of the stub has a shape corresponding to the shape of the body of the tie rod (more particularly, it has the same shape or almost the same shape—see for example FIG. 3C); the cavity 10 is so sized and shaped as to allow rotation of the body 11 inside the cavity 10 and trapping of the body 11 in the cavity 10 once rotated (this feature will be described better in the following with reference to FIGS. 3A-3D); the cavity 10 does not affect the hub of the compressor impeller 2 and the blades of the impeller 2 that project from the hub; a part of the tie rod 4 is located inside this through hole.

When the arrangement of FIG. 1 is assembled, the body 11 of the tie rod 4 is trapped in the cavity 10 (i.e. it cannot be extracted from the cavity by pulling the tie rod) and a surface of the body 11 is adjacent to a surface of the cavity 10 (as shown in FIG. 2B); the combination of such body and such cavity creates a sort of "bayonet" coupling 8.

The coupling 6 allows transmission of torque between the shaft 3 and the impeller 2; the coupling 7 allows transmission of torque between the shaft 3 and the impeller 1; the coupling 8 allows transmission of axial load between the tie rod 4 and the impeller 2.

As the transmission of axial load and the transmission of torque are obtained through distinct parts, it is easier to design each of these parts according to the corresponding requirements and therefore to achieve better results.

Additionally, the present solution is very simple and compact; in fact. only one tie rod is used which is located inside the shaft, the stub integrates both the torque transmitting coupling and the axial load transmitting coupling, and the axial load transmitting coupling is partially radially surrounded by the torque transmitting coupling and partially axially shifted forward with respect to the torque transmitting coupling.

Finally, according to the present solution, the impeller may be pulled axially without weakening its structure, in particular its hub; this allows higher rotation speed and higher head in case of a compressor impeller.

The body 11 of the embodiment of FIGS. 2A-2B is a radially shaped disk; in particular, this disk is thick and has four same-shaped lobes that are labeled 16A, 16B, 16C, 16D in FIG. 3A; the cavity 10 of the embodiment of FIGS. 2A-2B is cylindrical (this shape makes it easy to be manufactured); the hole 15 on the front side of the stub (see FIG. 3B) has the same shape of the disk 11 or, to be precise, almost the same shape in order to facilitate insertion (see FIG. 3C) and rotation (see FIG. 3D) of the disk together with the tie rod. More in general, a plurality of lobes may be provided each having its own radial shape that may be different from the one shown in FIG. 3.

Figure 4:
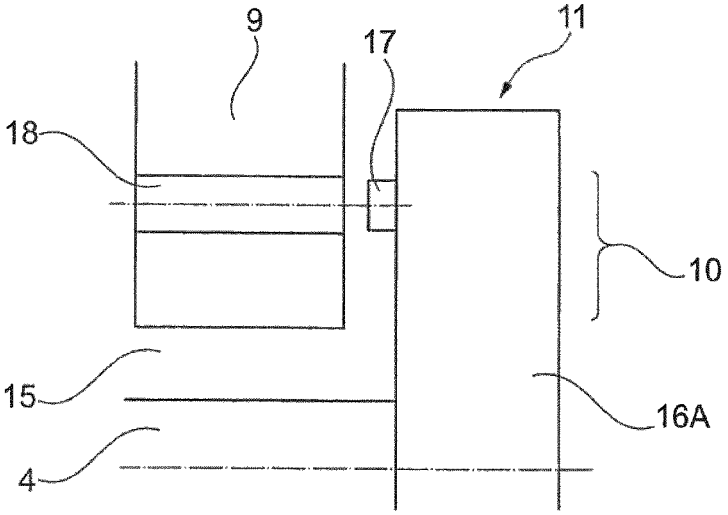
FIG. 4 shows a detail of FIG. 2B.

In order to avoid rotation of the body 11 and tie rod 4 with respect to the impeller 2 when the arrangement of FIG. 1 is assembled and the rotary machine rotates, the body 11 has a pin 17 and the stub 9 has a hole 18 beginning from the cavity 10 for receiving the pin 17, shown in FIG. 4; coupling of the pin 17 and the hole 18 takes place only when the body 11 is appropriately rotated.

In the embodiment of FIG. 4, the body 11 is a radially shaped disk and the pin 17 protrudes from one of the two parallel surfaces (perpendicular to the axis) of the disk; the cavity 10 has a corresponding surface (perpendicular to the axis) where the hole 18 begins; part of the surface of the disk abuts on part of the surface of the cavity; the pin 17 and the hole 18 are axially oriented so that insertion requires an axial movement.

In the embodiment of FIG. 4, the hole 18 is a through hole even if the pin 17 is much shorter that the hole 18; this is done for easy of manufacture.

Alternatively to FIG. 4, the pin may protrude from a surface of the cavity and the hole may begin from a surface of the body of the tie rod; anyway, is not done for easy of manufacture.

According to the above description of an embodiment, the method of connecting impeller to a shaft requires a tie rod, in particular only one tie rod, and provides: a bayonet coupling for coupling the tie rod to the impeller, a hirth coupling or a spline coupling for coupling the shaft to the impeller.

In particular, the bayonet coupling is used for transmitting axial load between the tie rod and the impeller and the hirth coupling or the spline coupling is used for transmitting torque between the shaft and the impeller.

If only one tie rod is used or if there is a main tie rod, the method provides to locate it more particularly inside an axial through hole of the shaft.

Considering the embodiment above described and shown in FIGS. 1-3D, connection comprises the steps of: inserting the body 11 of the tie rod 4 into the cavity 10 of a stub 9 of the impeller 2 (see FIG. 3C), rotating the tie rod 4 by an angle (labeled 19 in FIG. 3D) of a predetermined amplitude so to constrain the tie rod 4 to the impeller 2, in particular so to trap the body 11 in the cavity 10, placing the shaft 3 close to the impeller 2, mating the shaft coupling element of coupling 6, i.e. the toothed region of the shaft 3, with the impeller coupling element of coupling 6, i.e. the toothed region of the stub 9, tensioning the tie rod 4, securing the tie rod 4 to the shaft 3 by screwing the nut 5 and tightening it.

In the embodiment of FIGS. 3A-3D, the body 11 has four equally-spaced lobes 16A and 16B and 16C and 16D, correspondingly the axial hole 15 of the stub 9 has four equally-spaced lobes, and the rotation angle 19 has an ideal value of approximately 45° (that is shown as clock-wise in the figure) so that, after rotation the lobes of the body are in the middle between the lobes of the hole; if the solution of FIG. 4 is used, the value of the rotation angle 19 is precise as it is determined by the positions of the pin 17 and the hole 18.

It is to be noted that the above sequence of steps may change. For example, the rotation of the tie rod 4 and the body 11 may be done immediately after rotating the tie rod 4 by an angle (labeled 19 in FIG. 3D) of a predetermined amplitude so to constrain the tie rod 4 to the impeller 2, in particular so to trap the body 11 in the cavity 10 or immediately after placing the shaft 3 close to the impeller 2 or immediately after mating the shaft coupling element of coupling 6, i.e. the toothed region of the shaft 3, with the impeller coupling element of coupling 6, i.e. the toothed region of the stub 9, but necessarily before tensioning the tie rod 4. For example, the tie rod 4 may be inserted inside the hole 12 of the shaft 3, and the combination of the tie rod 4 and the shaft 3 may be placed close to the impeller 2; in other words, placing the shaft 3 close to the impeller 2 may be carried out before inserting the body 11 of the tie rod 4 into the cavity 10 of a stub 9 of the impeller 2 (see FIG. 3C). Anyway, necessarily tensioning the tie rod 4 follows rotating the tie rod 4 by an angle (labeled 19 in FIG. 3D) of a predetermined amplitude so to constrain the tie rod 4 to the impeller 2, in particular so to trap the body 11 in the cavity 10, tensioning the tie rod 4 follows mating the shaft coupling element of coupling 6, i.e. the toothed region of the shaft 3, with the impeller coupling element of coupling 6, i.e. the toothed region of the stub 9, securing the tie rod 4 to the shaft 3 by screwing the nut 5 and tightening it follows tensioning the tie rod 4.

If the pin 17 and the hole 18 are provided in the solution, the method comprises further the step of: inserting the pin 17 of the body 11 into the hole 18 of the stub 9; inserting the pin 17 of the body 11 into the hole 18 of the stub 9 need to be carried out after rotating the tie rod 4 by an angle (labeled 19 in FIG. 3D) of a predetermined amplitude so to constrain the tie rod 4 to the impeller 2, in particular so to trap the body 11 in the cavity 10 and before tensioning the tie rod 4.

The connection arrangement according to an embodiment of the present invention, in particular a connection arrangement as described above, is more particularly used in a rotary machine. For example, FIG. 1 relates to a turbo expander and only one embodiment of a connection arrangement according to the present invention is used.

In rotary machines having two impellers or two sets of impellers connected to a shaft, two connection arrangements according to embodiments of the present invention may be used; for example, a first connection arrangement may be used for a first set of impellers located on a first side of the shaft and a second connection arrangement may be used for a second set of impellers located on a second side of the shaft.

In this case, a solution identical or similar to that shown in FIG. 2B is used on both sides of the shaft and there is no nut adjacent to an impeller contrary to what is shown in FIG. 2A.

Figure 5:
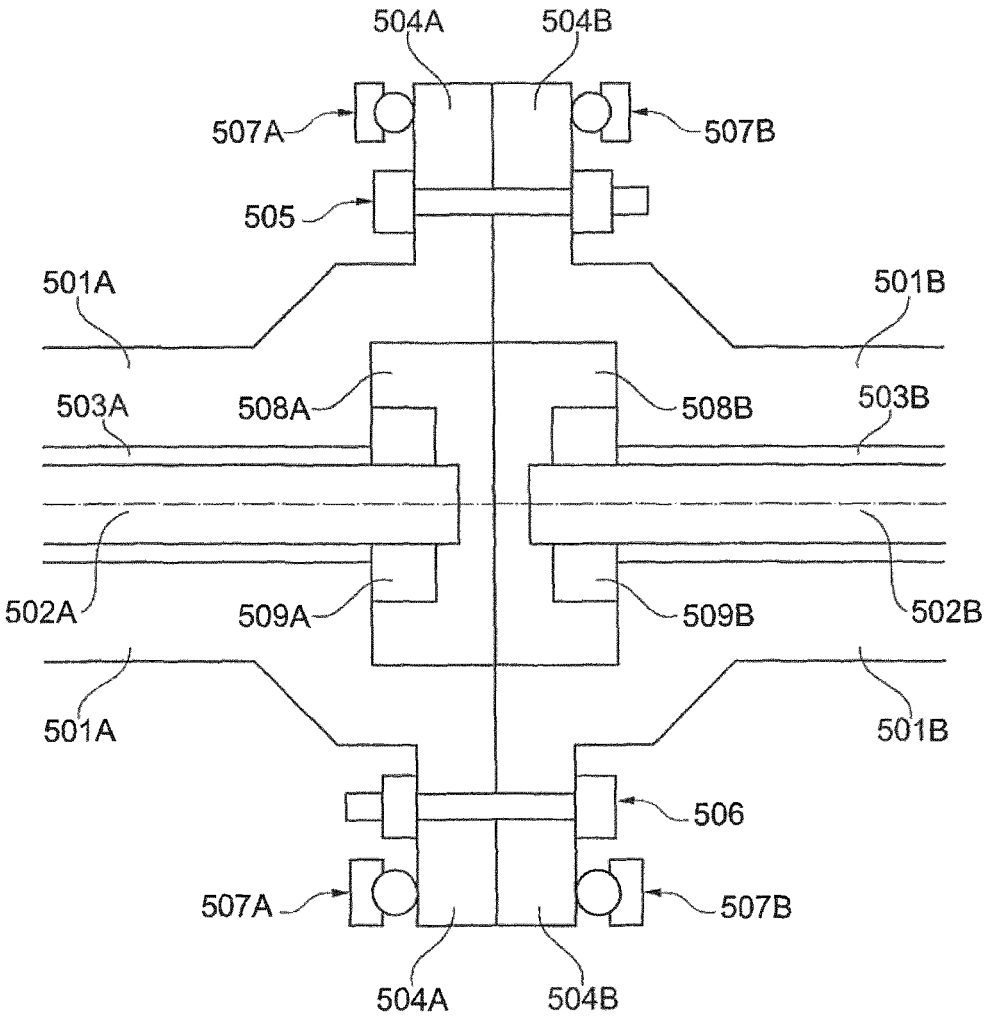
FIG. 5 shows a longitudinal cross-section of a detail of an embodiment alternative to the one in FIG. 1 and FIGS. 2A-2B.

FIG. 5 shows a detail of an embodiment according to the above mentioned alternative; this detail relates to the central portion of the shaft; the shaft is split into two distinct parts 501A and 501B connected together by nuts and bolts.

There are two tie rods 502A and 502B that are distinct and aligned; they are respectively located inside the axial through holes 503A and 503B of the tie rods 502A and 502B.

At the end of the tie rod 501A there is an integral (or alternatively attached) flange 504A; at the end of the tie rod 501B there is an integral (or alternatively attached) flange 504B; the flanges 504A and 504B are connected together by nuts and bolts; in FIG. 5, for example, there is an upper nut and bolt 505 wherein its nut is adjacent to the flange 504B and a lower nut and bolt 506 wherein its nut is adjacent to the flange 504A.

In an embodiment, as shown in FIG. 5, thrust bearings 507A and 507B are associated respectively to the flange 504A and to the flange 504B.

The tie rod 502A is secured to the shaft part 501A through a nut 509A; an end part of the tie rod 502A is threaded; the nut 509A is screwed and tighten onto to it; the flange 504A has a recess 508A on its front side that is designed to house the end part of the tie rod 502A and the nut 509A; the recess 508A has a surface (perpendicular to the axis) recessed with respect to the front surface of the flange 504A; when this connection arrangement is assembled (as in FIG. 5), the nut 509A is adjacent to this recessed surface.

In the same way, the tie rod 502B is secured to the shaft part 501B through a nut 509B.

The assembly process provides that initially a first impeller is connected to a first shaft part, then a second impeller is connected to a second shaft part, finally the first shaft part (together with the first impeller or first set of impellers) is connected to the second shaft part (together with the second impeller or second set of impellers).

In this way, none of the two end impellers of the rotary machine are weakened.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A connection arrangement comprising:

a shaft having an axial through hole, a tie rod located inside the axial through hole, wherein at an end of the tie rod there is an integral body having a shape radially protruding from the tie rod, and an impeller comprising a solid hub, a plurality of blades, and an integral stub protruding axially from the solid hub;

wherein the stub has a cavity for receiving the body and an axial hole for inserting the body into the cavity, the stub axial hole having a shape corresponding to the shape of the body, the cavity being so sized and shaped as to allow rotation of the body inside the cavity and trapping of the body in the cavity once rotated;

wherein the body has a pin and the stub has a hole beginning from the cavity for receiving the pin and the pin and the hole are axially oriented;

wherein the shaft and the impeller are coupled together by a coupling;

wherein the trapping allows transmission of axial load between the tie rod and the impeller;

and wherein the coupling allows transmission of torque between the shaft and the impeller.

2. The connection arrangement of claim 1, wherein the coupling is a hirth coupling or a spline coupling.

3. The arrangement of claim 1, wherein the coupling is located at an outer perimeter region of the stub.

4. The connection arrangement of claim 1, wherein the hole receives the pin once the body is rotated.

5. The connection arrangement of claim 1, further comprising a nut and wherein the nut secures the tie rod once the tie rod is tensioned.

6. A rotary machine comprising at least one connection arrangement according to claim 1.

7. The rotary machine of claim 6, wherein the at least one connection arrangement comprises a first connection arrangement and a second connection arrangement, wherein the tie rod of the first connection arrangement and the tie rod of the second connection arrangement are distinct and aligned.

8. The rotary machine of claim 7, wherein the hollow shaft of the first connection arrangement and the shaft of the second connection arrangement are connected together.

9. The rotary machine of claim 8, wherein the hollow shaft of the first connection arrangement and the shaft of the second connection arrangement are connected together by means of a first flange and a second flange and nuts and bolts.

10. The rotary machine of claim 9, wherein thrust bearings are associated to the first flange and/or to the second flange.

11. The rotary machine of claim 6, where the rotary machine is a turbo expander.

12. A connection arrangement comprising:

a shaft having an axial through hole, a tie rod located inside the axial through hole, wherein at an end of the tie rod there is an integral body having a shape radially protruding from the tie rod, the body having an axially oriented pin, and an impeller comprising a solid hub, a plurality of blades, and an integral stub protruding axially from the solid hub;

wherein the stub has a cavity for receiving the body and an axial hole for inserting the body into the cavity and for receiving the pin once the body is rotated, the stub axial hole having a shape corresponding to the shape of the body, the cavity being so sized and shaped as to allow rotation of the body inside the cavity and trapping of the body in the cavity once rotated;

wherein the shaft and the impeller are coupled together by a coupling;

wherein the trapping allows transmission of axial load between the tie rod and the impeller; and wherein the coupling allows transmission of torque between the shaft and the impeller.

13. The connection arrangement of claim 12, wherein the coupling is a hirth coupling or a spline coupling.

14. The connection arrangement of claim 12, further comprising a nut and wherein the nut secures the tie rod once the tie rod is tensioned.

* * * * *